US011477596B2

(12) United States Patent
Weissman et al.

(10) Patent No.: US 11,477,596 B2
(45) Date of Patent: Oct. 18, 2022

(54) CALIBRATION OF SYNCHRONIZED AUDIO PLAYBACK ON MICROPHONE-EQUIPPED SPEAKERS

(71) Applicant: WAVES AUDIO LTD., Tel Aviv (IL)

(72) Inventors: Nahum Noam Weissman, Petach Tikva (IL); Matan Ben-Asher, Yahud (IL); Itai Neoran, Beit-Hananya (IL)

(73) Assignee: WAVES AUDIO LTD., Tel Aviv (IL)

( * ) Notice: Subject to any disclaimer, the term of this patent is extended or adjusted under 35 U.S.C. 154(b) by 0 days.

(21) Appl. No.: 17/063,794

(22) Filed: Oct. 6, 2020

(65) Prior Publication Data

US 2021/0112362 A1 Apr. 15, 2021

Related U.S. Application Data

(60) Provisional application No. 62/913,183, filed on Oct. 10, 2019.

(51) Int. Cl.
*H04S 7/00* (2006.01)
*H04R 1/40* (2006.01)

(52) U.S. Cl.
CPC ..... *H04S 7/303* (2013.01); *H04R 1/406* (2013.01)

(58) Field of Classification Search
CPC ..... H04S 7/303; H04R 1/406
USPC ..... 381/56, 58, 91, 124, 303
See application file for complete search history.

(56) References Cited

U.S. PATENT DOCUMENTS 9,538,308 B2 1/2017 Isaac
2004/0151476 A1* 8/2004 Suzuki ..... H04S 7/301 386/239
2005/0152557 A1* 7/2005 Sasaki ..... H04S 7/302 381/59

(Continued)

FOREIGN PATENT DOCUMENTS

GB 2457508 B 6/2010

OTHER PUBLICATIONS

DV Le, J Kamminga, H Scholten, PJM Havinga "A Framework to Measure Reliance of Acoustic Latency on Smartphone Status" 2018 IEEE International Conference on Pervasive Computing and Communication.

(Continued)

*Primary Examiner* — William A Jerez Lora
(74) *Attorney, Agent, or Firm* — Oliff PLC

(57) ABSTRACT

A computerized microphone-equipped audio playback device comprising a speaker and microphone and being configured to receive digital audio; and play the digital audio on a speaker, in accordance with a playback delay that is derivative of, at least: an arrival time of a first calibration sound at the processor and an arrival time of the first calibration sound at a second microphone-equipped audio playback device, wherein the first calibration sound originated at the listener position; a generation time of a second calibration sound at the second microphone-equipped audio playback device, and an arrival time of the second calibration sound at the processor; and a generation time of a third calibration sound at the processor, and an arrival time of the third calibration sound at the second microphone-equipped audio playback device; thereby synchronizing arrival of sound of the two playback devices at the listener position.

14 Claims, 13 Drawing Sheets

(56) References Cited

U.S. PATENT DOCUMENTS

2019/0103849 A1* 4/2019 Shaya ..... H04R 1/406

OTHER PUBLICATIONS

Kevin Luchsinger "Distributed Speaker Synchronization—Semester Thesis" Distributed Computing Group, Computer Engineering and Networks Laboratory ETH Zürich.

Lee K S, Lee S P. "A real-time audio system for adjusting the sweet spot to the listener's position" IEEE Transactions on Consumer Electronics, 2009, 56(2): 835-843.

Knapp, C. H. and G.C. Carter, "The Generalized Correlation Method for Estimation of Time Delay." IEEE Transactions on Acoustics, Speech, and Signal Processing. vol. ASSP-24, No. 4, Aug. 1976.

* cited by examiner

CALIBRATION OF SYNCHRONIZED AUDIO PLAYBACK ON MICROPHONE-EQUIPPED SPEAKERS

TECHNICAL FIELD

The presently disclosed subject matter relates to playback of digital audio, and in particular to implementation of systems for simultaneous playback of digital audio on multiple speakers.

BACKGROUND

Problems of implementation in systems of digital audio playback have been recognized in the conventional art and various techniques have been developed to provide solutions.

GENERAL DESCRIPTION

According to a further aspect of the presently disclosed subject matter there is provided a computerized microphone-equipped audio playback device comprising a processing circuitry, the processing circuitry comprising a speaker and microphone, and being configured to:

a) receive data indicative of digital audio; and b) play the digital audio on a speaker, in accordance with a playback delay, the playback delay being in accordance with a first listener position propagation differential that is derivative of, at least:

i) data indicative of an arrival time of a first calibration sound at the processor and data indicative of an arrival time of the first calibration sound at a second microphone-equipped audio playback device, wherein the first calibration sound originated at the listener position, ii) data indicative of a generation time of a second calibration sound at the second microphone-equipped audio playback device, and data indicative of an arrival time of the second calibration sound at the processor, and iii) data indicative of a generation time of a third calibration sound at the processor, and data indicative of an arrival time of the third calibration sound at the second microphone-equipped audio playback device;

thereby synchronizing arrival of sound of the first microphone-equipped audio playback device and the second microphone-equipped audio playback device at the listener position.

1. A computer program product comprising a non-transitory computer readable storage medium retaining program instructions, which, when read by a processing circuitry, cause the processing circuitry to perform a computerized method of providing a user with a persistent view of syndicated content items, the method comprising:

a) receiving, by a processor of a first microphone-equipped playback device, data indicative of digital audio; and b) playing the digital audio, by the processor, on a speaker of the first microphone-equipped playback device, in accordance with a playback delay, the playback delay being in accordance with a first listener position propagation differential that is derivative of, at least:

i) data indicative of an arrival time of a first calibration sound at the processor and data indicative of an arrival time of the first calibration sound at a second microphone-equipped playback device, wherein the first calibration sound originated at the listener position, ii) data indicative of a generation time of a second calibration sound at the second microphone-equipped playback device, and data indicative of an arrival time of the second calibration sound at the processor, and iii) data indicative of a generation time of a third calibration sound at the processor, and data indicative of an arrival time of the third calibration sound at the second microphone-equipped playback device;

thereby synchronizing arrival of sound of the first microphone-equipped speaker and the second microphone-equipped speaker at the listener position.

According to another aspect of the presently disclosed subject matter there is provided a computer program product comprising a non-transitory computer readable storage medium retaining program instructions, which, when read by a processing circuitry, cause the processing circuitry to perform a computerized method of providing a user with a persistent view of syndicated content items, the method comprising:

a) receiving, by a processor of a first microphone-equipped playback device, data indicative of digital audio; and b) playing the digital audio, by the processor, on a speaker of the first microphone-equipped playback device, in accordance with a playback delay, the playback delay being in accordance with a first listener position propagation differential that is derivative of, at least:

i) data indicative of an arrival time of a first calibration sound at the processor and data indicative of an arrival time of the first calibration sound at a second microphone-equipped playback device, wherein the first calibration sound originated at the listener position, ii) data indicative of a generation time of a second calibration sound at the second microphone-equipped playback device, and data indicative of an arrival time of the second calibration sound at the processor, and iii) data indicative of a generation time of a third calibration sound at the processor, and data indicative of an arrival time of the third calibration sound at the second microphone-equipped playback device;

thereby synchronizing arrival of sound of the first microphone-equipped speaker and the second microphone-equipped speaker at the listener position.

BRIEF DESCRIPTION OF THE DRAWINGS

In order to understand the invention and to see how it can be carried out in practice, embodiments will be described, by way of non-limiting examples, with reference to the accompanying drawings, in which.

DETAILED DESCRIPTION

In the following detailed description, numerous specific details are set forth in order to provide a thorough understanding of the invention. However, it will be understood by those skilled in the art that the presently disclosed subject matter may be practiced without these specific details. In other instances, well-known methods, procedures, components and circuits have not been described in detail so as not to obscure the presently disclosed subject matter.

Unless specifically stated otherwise, as apparent from the following discussions, it is appreciated that throughout the specification discussions utilizing terms such as "processing", "computing", "generating", "playing", "detecting", "noting", "calculating", "receiving", "providing", "obtaining", "measuring", "communicating" or the like, refer to the action(s) and/or process(es) of a computer that manipulate and/or transform data into other data, said data represented as physical, such as electronic, quantities and/or said data representing the physical objects. The term "computer" should be expansively construed to cover any kind of hardware-based electronic device with data processing capabilities including, by way of non-limiting example, the processor, mitigation unit, and inspection unit therein disclosed in the present application.

The terms "non-transitory memory" and "non-transitory storage medium" used herein should be expansively construed to cover any volatile or non-volatile computer memory suitable to the presently disclosed subject matter.

The operations in accordance with the teachings herein may be performed by a computer specially constructed for the desired purposes or by a general-purpose computer specially configured for the desired purpose by a computer program stored in a non-transitory computer-readable storage medium.

Embodiments of the presently disclosed subject matter are not described with reference to any particular programming language. It will be appreciated that a variety of programming languages may be used to implement the teachings of the presently disclosed subject matter as described herein.

Figure 1:
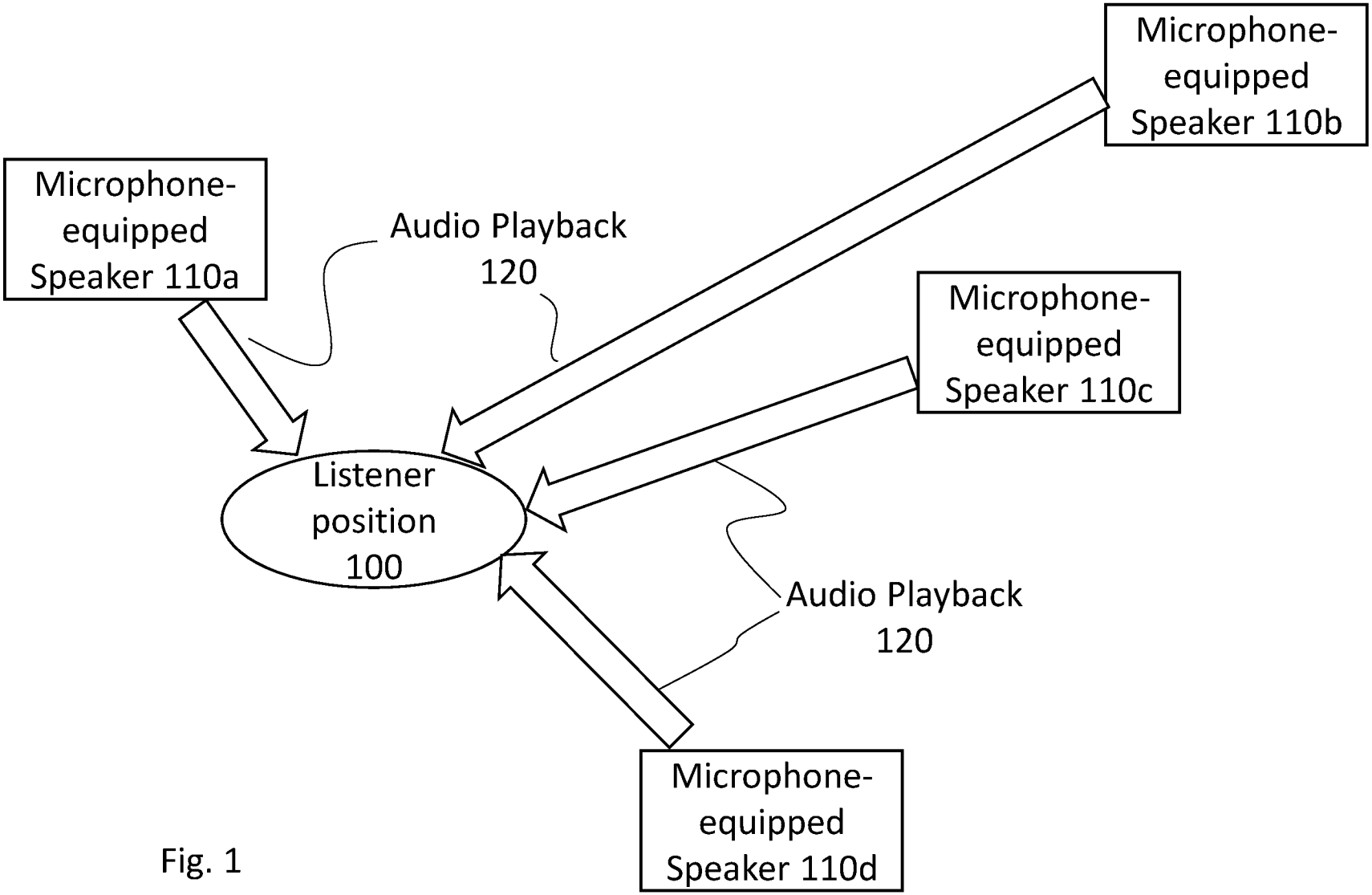
FIG. 1 illustrates an example scenario where multiple microphone-equipped speakers play audio which reaches a listener located at a particular listener position, in accordance with some embodiments of the presently described subject matter.

Attention is now directed to FIG. 1, which illustrates an example scenario where multiple microphone-equipped speakers play audio which reaches a listener located at a particular listener position, in accordance with some embodiments of the presently described subject matter.

In recent years, "smart" speakers have become increasing popular. A smart speaker is, in some examples, a wireless device (that includes a processor) which communicates with a user via a voice command interface i.e. the user makes requests commands (e.g. for weather, news, checking a schedule, control of home thermostat, alarm, appliances etc.), and the speaker responds by performing requested actions and by communicating to the user with a human-like voice. Google Home™, Amazon Echo™ and Apple HomePod™ are examples of smart speakers.

Playing music is another common use of smart speakers—for example: using streaming applications such as Spotify™, Apple Music™, Deezer™ etc. While many smart speakers are stereophonic, their compact design limits their ability to give the listener a stereophonic sound experience.

A system using two or more smart speaker devices can—in principle—play music with an enhanced stereophonic or multichannel experience. But such an arrangement can have synchronization problems: the devices' clocks are not synchronized, and the latency imposed in each speaker by digital-analog conversion (DAC) and other delays is not necessarily identical.

Moreover, as in every stereophonic system, if a listener is closer to one loudspeaker than to the other, the audio from the closer loudspeaker arrives earlier and louder at the listener's ears. Consequently the listener can perceive that the sound comes from a place near the closer loudspeaker rather than from the center of both loudspeakers.

In some embodiments of the presently disclosed subject matter, a multi microphone-equipped playback device system performing time synchronization—and optionally gain alignment—relative to the listener's location can enhance and optimize the listening experience.

It is noted that amplitude decay of a direct sound wave is approximately proportional to 1/r where r is the distance between the listener and the sound source (within distance range where the reverberation can be neglected).

In some embodiments of the presently disclosed subject matter, two or more microphone-equipped playback devices play the same audio signal. In some embodiments, two or more microphone-equipped playback devices play respective channels of multi-channel content. In some embodiments, an external device transmits digital audio to all of the microphone-equipped playback devices. In some embodiments, each of the microphone-equipped playback devices accesses identical audio content (e.g. from internal disk or network server).

The description hereinbelow addresses an example scenario where one external device transmits individual channels of a multi-channel stream to respective microphone-equipped playback devices. The same method, with minor modifications, can be utilized for other audio-source cases such as those mentioned hereinabove, as known in the art.

The term "optimal listening position" (or "sweet spot") can refer to a point at which all wave fronts from all loudspeakers arrive simultaneously. The optimal listening position can be steered to a listener's location by adjusting the play time on each loudspeaker. Similarly playback gain can be adjusted in order to correct the level difference at the optimal listening position.

Some embodiments of the presently disclosed subject matter employ a computer-based method that considers all factors affecting arrival time of audio at the listener's location (e.g. clocks not in sync, codec delay, driver delay, buffer drops, DAC delay etc.) and compensates for all of them together—without knowledge of the geometry or positions of loudspeakers and/or listener, and without explicitly computing the absolute positions or relative positions of the loudspeakers and/or listener. In addition, some embodiments of the presently disclosed subject matter compensate for loudness differences between the loudspeakers at the listener's location due to the different distances from the listener, resulting in a different decay in energy.

In FIG. 1, microphone-equipped playback devices 110*a* 110*b* 110*c* 110*d* loudspeakers play audio (all play the same stream, or each plays one channel of a multi-channel stream such as 5.1 7.1 etc.). Sound from the closest microphone-equipped playback device 110*a* arrives at listener position 100 prior to and with less amplitude decay than the sound from the other microphone-equipped playback devices due to the different distances. In addition, there can be other factors that affect the arrival times of the sounds: e.g driver latency, DAC latency, and unsynchronized clocks.

Figure 2:
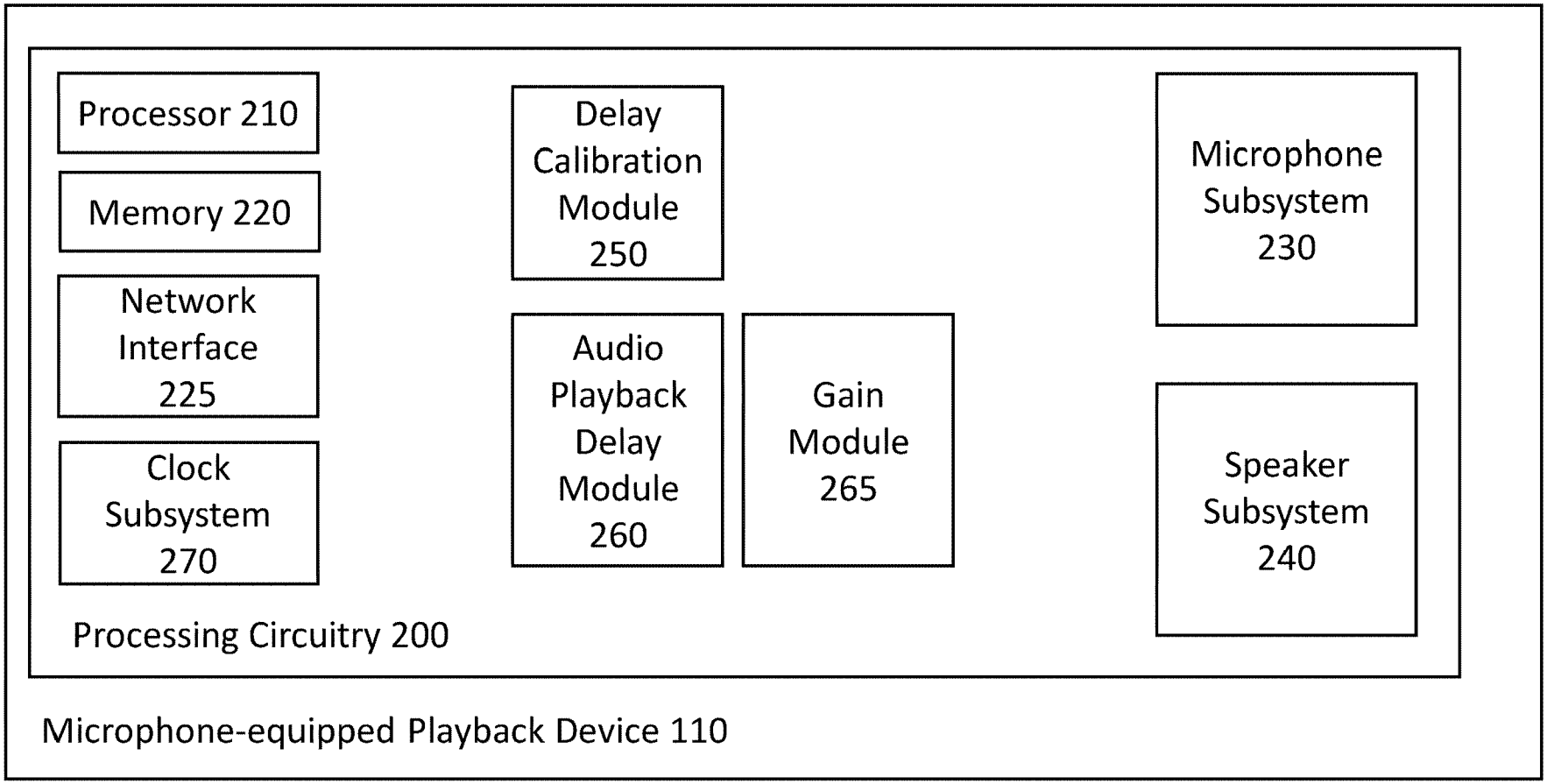
FIG. 2 illustrates a block diagram of an example microphone-equipped playback device with its components, in accordance with some embodiments of the presently described subject matter.

Attention is now directed to FIG. 2, which illustrates a block diagram of an example microphone-equipped playback device with its components, in accordance with some embodiments of the presently disclosed subject matter.

Microphone-equipped playback device 110 can include processing circuitry 200. Processing circuitry 200 can include processor 210 and memory 220.

Processor 210 can be a suitable hardware-based electronic device with data processing capabilities, such as, for example, a general purpose processor, digital signal processor (DSP), a specialized Application Specific Integrated Circuit (ASIC), one or more cores in a multicore processor etc. Processor 210 can also consist, for example, of multiple processors, multiple ASICs, virtual processors, combinations thereof etc.

Memory 220 can be, for example, a suitable kind of volatile or non-volatile storage, and can include, for example, a single physical memory component or a plurality of physical memory components. Memory 220 can also include virtual memory. Memory 220 can be configured to, for example, store various data used in computation.

Network interface 225 can be a suitable type of interface to a wired or wireless network communications device that provides data connectivity to e.g. other microphone-equipped speakers, streaming playback devices, etc.

Clock subsystem 270 can be a suitable type of hardware and/or software mechanism for making time available to components microphone-equipped playback device 110. In some embodiments, the time made available by clock subsystem 270 need not be synchronized with clocks of peer microphone-equipped playback devices.

Microphone subsystem 230 can be a suitable type of hardware and/or software subsystem that receives sound the (e.g. voice commands, recordable audio etc.) from an area external to microphone-equipped playback device 110. Microphone subsystem 230 can include e.g. a hardware microphone, an analog-to-digital component, software etc. There can be a delay from the time that a sound reaches the microphone and the time that e.g. a digital representation of the sound is handled by processor 210. This delay imposed by microphone subsystem 230 or its components can be at least part of a delay that is herein termed "ingress delay".

Speaker subsystem 240 can be a suitable type of hardware and/or software subsystem that receives data indicative of digital audio (from e.g. processor 210) and plays the audible sound. Speaker subsystem 240 can include e.g. codec processing software, digital-to-analog component, a hardware speaker, etc. There can be a delay from the time that a digital audio is transmitted by the processor 210 and the time that sound is played. This delay imposed by speaker subsystem 240 or its components can be at least part of a delay that is herein termed "egress delay".

Processor 210 can be configured to execute several functional modules in accordance with computer-readable instructions implemented on a non-transitory computer-readable storage medium. Such functional modules are referred to hereinafter as comprised in the processor. These modules can include, for example, delay calibration module 250, audio playback delay model 260 and gain module 265.

Delay calibration module 250 can be operably connected to microphone subsystem 230 and can receive data indicative of received sound. Delay calibration module 250 can be operably connected to speaker subsystem 240 and can receive data indicative of sound for playback. Delay calibration module 250 can be operably connected to network interface 225 and can exchange data with e.g peer microphone-equipped playback devices and/or servers. Delay calibration module 250 can perform methods of delay and gain calibration, as described in detail below with reference to FIGS. 5-10 and can determine and/or receive a delay value that can be imposed on arriving audio before playback to accomplish time synchronization, and optionally also a gain value that can be imposed to accomplish gain alignment.

Audio playback delay module 260 can impose a delay value (e.g. as determined from data provided by delay calibration module 250) for digital audio that is to be played out e,g, on speaker subsystem 240. This procedure is described in more detail below with reference to FIG. 4.

Gain module 265 can be impose a gain value (e.g. as determined from data provided by delay calibration module 250) for digital audio that is to be played out e,g, on speaker subsystem 240. This procedure is described in more detail below with reference to FIG. 4.

It is noted that the teachings of the presently disclosed subject matter are not bound by the system described with reference to FIG. 2. Equivalent and/or modified functionality can be consolidated or divided in another manner and can be implemented in any appropriate combination of software with firmware and/or hardware and executed on a suitable device. The microphone-equipped playback device 110 can be a standalone entity, or integrated, fully or partly, with other entities.

Figure 3:
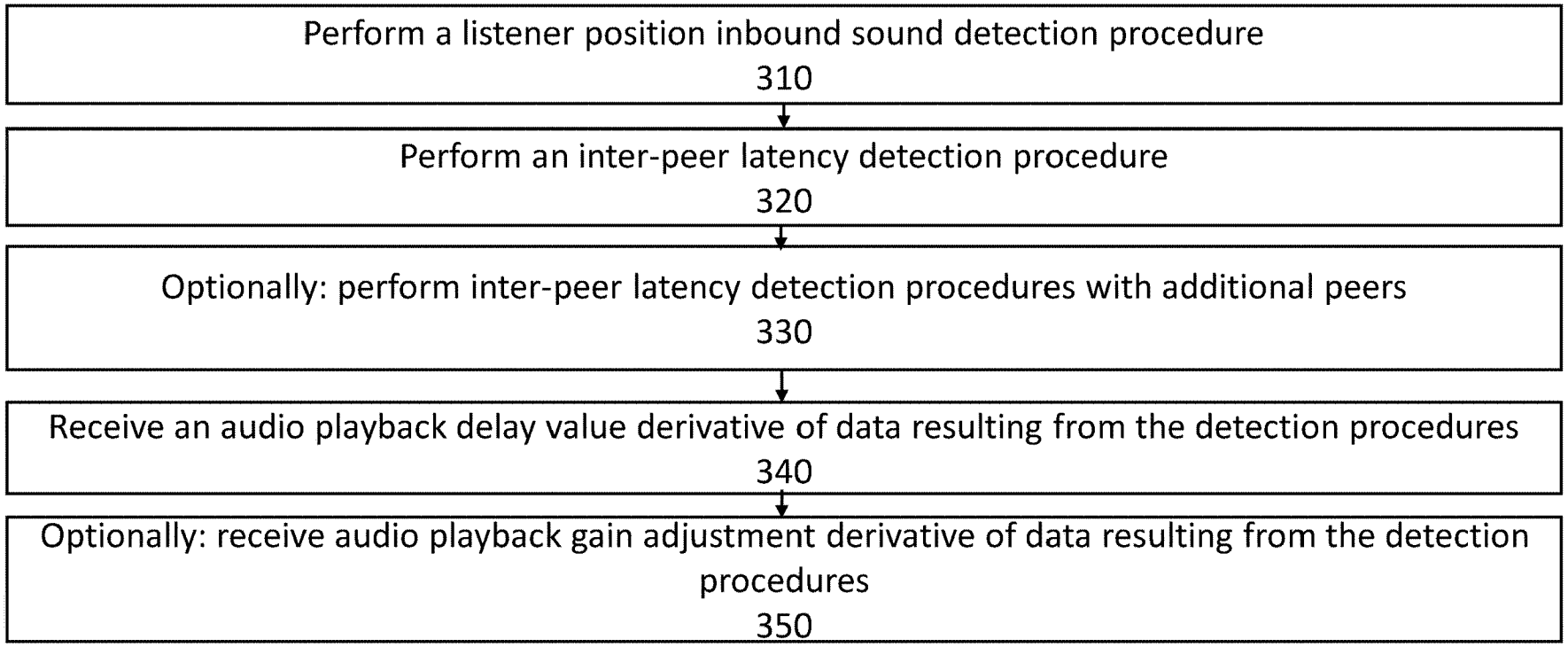
FIG. 3 illustrates a flow diagram of an example method of calibrating a microphone-equipped playback device to enable synchronized audio playback, in accordance with some embodiments of the presently described subject matter.

Attention is now directed to FIG. 3, which illustrates a flow diagram of an example method of calibrating a microphone-equipped playback device to enable synchronized audio playback, in accordance with some embodiments of the presently disclosed subject matter.

Processing circuitry 200 (e.g. delay calibration module 250) can begin by performing a calibration (310) method that is herein termed a listener position inbound sound detection procedure. This procedure is described in detail below with reference to FIGS. 5A-5B. The listener position inbound sound detection procedure can result in data indicative of a reception time (e.g. by the processor) of data indicative of a calibration sound (e.g. received at microphone subsystem 230) that was generated at listener position 100. Reception time (e.g. as generated by clock subsystem 270) on a first device of a sound generated at the listener position 100 is herein denoted as $R_{LP \rightarrow first}$.

Processing circuitry 200 (e.g. delay calibration module 250) can next perform a calibration (320) method that is herein termed an inter-peer latency detection procedure. This procedure is described in detail below with reference to FIGS. 6A-6B. The inter-peer latency detection procedure can result in data indicative of a reception time of a calibration sound that was generated by a particular peer microphone-equipped playback device. Reception time (e.g. as generated by clock subsystem 270) on a first device of a sound generated at a particular peer microphone-equipped playback device is herein denoted as $R_{Peer \rightarrow first}$.

The inter-peer latency detection procedure can additionally result in data indicative of a generation time (e.g. by processor 210) of a calibration sound that was played by a speaker subsystem 240. Generation time (e.g. as generated by clock subsystem 270) on a first device of a sound played and subsequently received at a particular peer microphone-equipped playback device is herein denoted as $T_{First \rightarrow peer}$.

Optionally: processing circuitry 200 (e.g. delay calibration module 250) can perform (330) additional inter-peer latency detection procedures with additional peer microphone-equipped playback devices. Each additional performance of the procedure can result in another $R_{Peer \rightarrow first}$ value and corresponding $T_{First \rightarrow peer}$ value for the respective peer microphone-equipped playback device. It is noted inter-peer latency detection need not be carried out separately for each peer, and that methods can simultaneously perform inter-peer latency detection to multiple peers, as described below with reference to FIGS. 6A-6C.

Processing circuitry 200 (e.g. delay calibration module 250) can next receive (340) an audio playback delay value derivative of data resulting from the detection procedures. In some embodiments, a central server communicates with each microphone-equipped playback device to receive measured calibration data, and then computes audio playback delay values which it then transmits back to the microphone-equipped playback devices. Details of this procedure are described below, with reference to FIGS. 7-10.

In some embodiments, the audio playback delay value is in accordance with a calculated "listener position propagation differential" e.g. a calculated difference in the time required for egress delay and sound propagation from the current speaker to the listener position and time required for egress delay and sound propagation from a peer speaker to the listener position.

By way of non-limiting example: in a scenario of playing streaming audio over two microphone-equipped playback devices, it might be calculated that the left channel microphone-equipped playback device has a delay of 10 ms from generation of sound by a processor until reception of the sound at the listener position 100 (this delay can include egress delay such as DAC delay etc., sound propagation delay, etc.). Similarly, it might be calculated that the right channel microphone-equipped playback device has a delay of 12 ms from generation of sound by a processor until reception of the sound at the listener position 100.

In this example scenario, the left-channel microphone-equipped playback device can be configured to delay audio output for 2 ms (i.e. the listener position propagation differential)—thus synchronizing sound arrival at the listener position 100.

Alternatively, in this example scenario, the right-channel microphone-equipped playback device can be configured to delay audio output for 1 ms, and the left-channel microphone-equipped playback device can be correspondingly configured to delay audio output for 3 ms (i.e. in accordance with the listener position propagation differential)—thus synchronizing sound arrival at the listener position 100

Optionally: Processing circuitry 200 (e.g. delay calibration module 250) can also receive (350) an audio playback gain adjustment that is derivative of data resulting from the detection procedures, as described below with reference to FIGS. 7 and 10.

It is noted that the teachings of the presently disclosed subject matter are not bound by the flow diagram illustrated in FIG. 3, and that in some cases the illustrated operations (for example steps 310 and 320) may occur concurrently or out of the illustrated order. It is also noted that whilst the flow chart is described with reference to elements of the system of FIG. 2, this is by no means binding, and the operations can be performed by elements other than those described herein.

Figure 4:
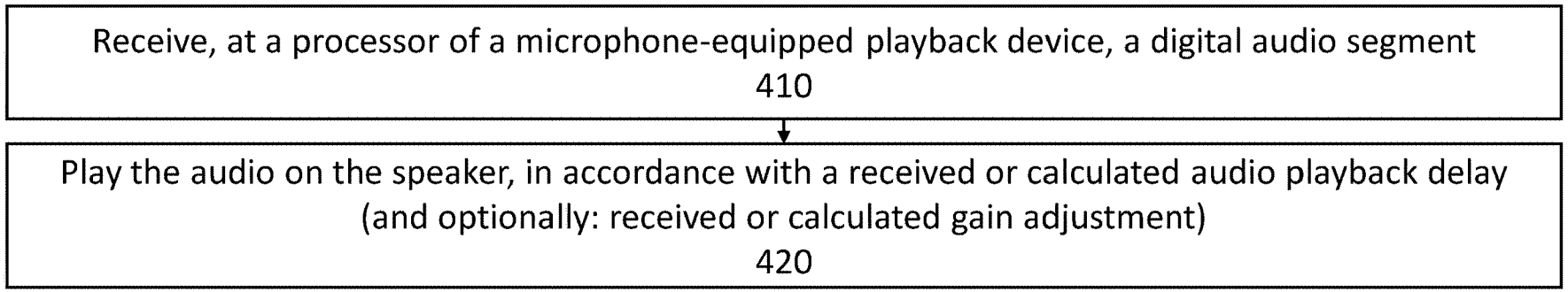
FIG. 4 illustrates a flow diagram of an example method of listener position optimized playback of digital audio on a microphone-equipped speaker device, in accordance with some embodiments of the presently described subject matter.

Attention is now directed to FIG. 4, which illustrates a flow diagram of an example method of listener position optimized playback of digital audio on a microphone-equipped speaker device, in accordance with some embodiments of the presently disclosed subject matter.

Processing circuitry 200 (e.g. audio playback delay module 260) can receive (410) a digital audio segment from e.g. a network-based media server. The digital audio segment can arrive at microphone-equipped playback device via e.g. network interface 225. The digital audio segment can be in any compressed or uncompressed digital audio format.

Processing circuitry 200 (e.g. audio playback delay module 260) can delay (420) before playing the digital audio (for example on speaker subsystem 240), in accordance with—for example—a received or calculated audio playback delay value. The delaying can be performed by buffering the digital audio data, instructing speaker subsystem 240 to perform the delay, or other techniques known in the art.

Optionally: processing circuitry 200 (e.g. gain module 265) can also adjust (430) the gain of the audio (for example: before playback on speaker subsystem 240 or by instructing speaker subsystem 240 to perform the adjustment, or other suitable methods) in accordance with a received or calculated gain adjustment.

Following delay and optional gain adjustment, processing circuitry 200 (e.g. speaker subsystem 240) can play (440) the audio segment.

By way of non-limiting example: Two microphone-equipped playback devices can be receiving a stream of music from a server of an internet-based streaming music service. Upon receiving a segment of audio, one microphone-equipped playback device can delay it by a received value (e.g. 2 ms) and adjust the gain by a received value (e.g. 6 dB) before playback. After playback, the sound can reach the listener position with the same timing and loudness as its peer microphone-equipped playback devices—resulting in an enhanced listening experience in comparison to unsynchronized or non-gain adjusted listening.

As described above with reference to FIG. 3, the audio playback delay value can be in accordance with one or more listener position propagation differential values, where each listener position propagation differential is a difference between the sound propagation times (to the listener position 100) of two devices.

As will be described in more detail below, a listener position propagation differential can be derivative of, at least:

i) data indicative of an arrival time of a first calibration sound at the processor 210 and data indicative on an arrival time of the first calibration sound at a second microphone-equipped playback device, wherein the first calibration sound originated at the listener position 100, ii) data indicative of a generation time of a second calibration sound at the second microphone-equipped playback device, and data indicative of an arrival time of the second calibration sound at the processor 210, and iii) data indicative of a generation time of a third calibration sound at the processor 210, and data indicative of an arrival time of the third calibration sound at the second microphone-equipped playback device.

It is noted that the teachings of the presently disclosed subject matter are not bound by the flow diagram illustrated in FIG. 4. It is also noted that whilst the flow chart is described with reference to elements of the system of FIG. 2, this is by no means binding, and the operations can be performed by elements other than those described herein.

Figure 5A:
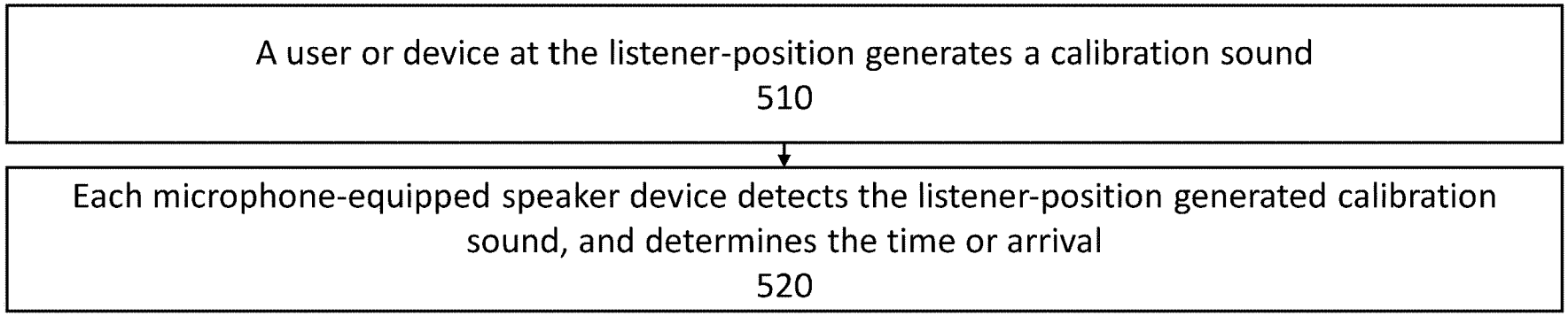
FIG. 5A illustrates a flow diagram of an example of a calibration method termed a listener-position inbound sound detection procedure, in accordance with some embodiments of the presently described subject matter.
Figure 5B:
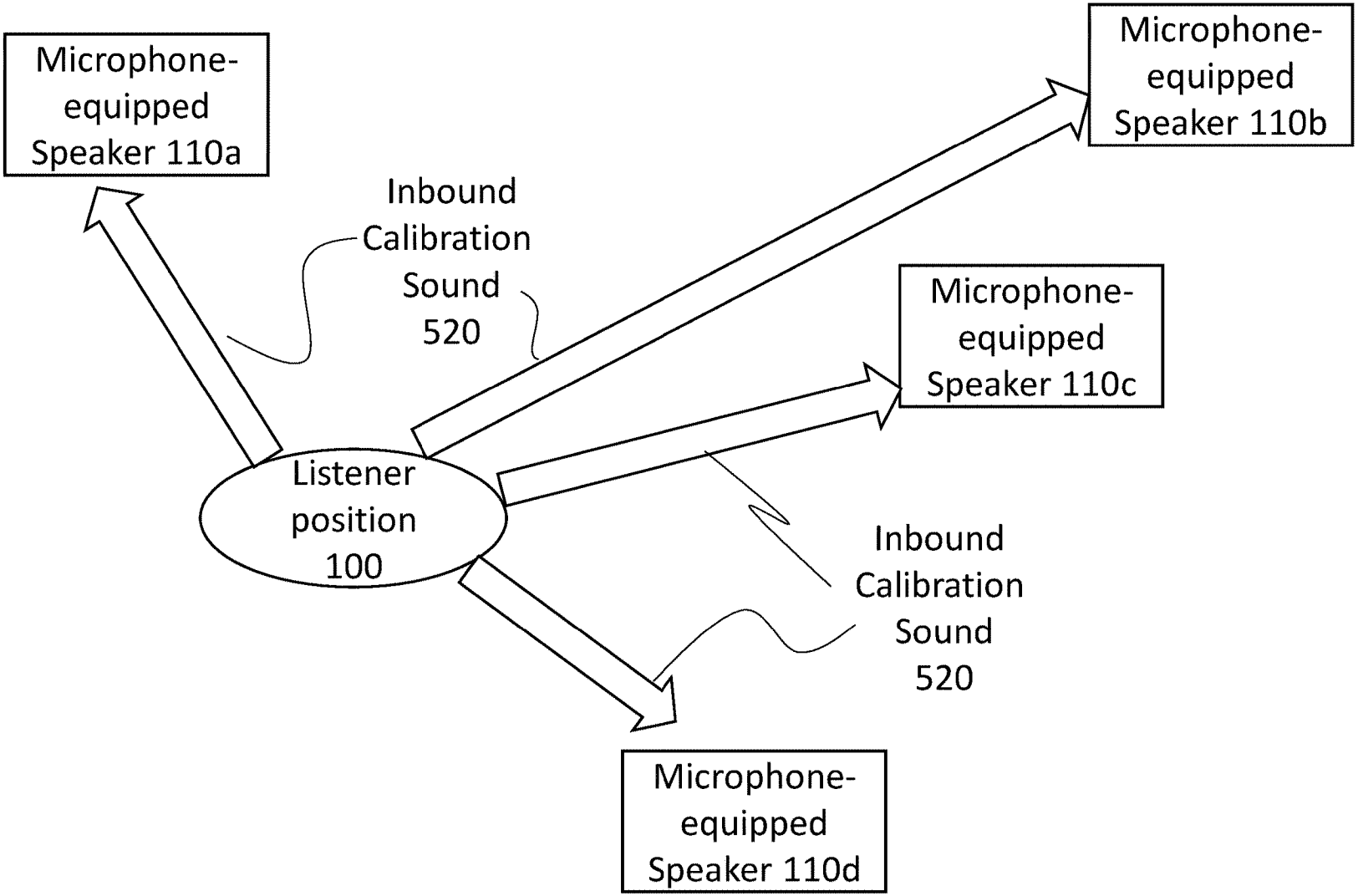
FIG. 5B illustrates an example deployment scenario and audio flow, in accordance with some embodiments of the presently described subject matter.

Attention is now directed to FIG. 5A, which illustrates a flow diagram of an example of a calibration method termed a listener-position inbound sound detection procedure, in accordance with some embodiments of the presently disclosed subject matter. FIG. 5B illustrates a corresponding example deployment scenario and audio flow, in accordance with some embodiments of the presently disclosed subject matter.

A user or device at the listener-position 100 can generate (510) an inbound calibration sound 520. This can be a e.g. a user uttering a calibration phrase (e.g. "calibrate"), a smartphone app generating a particular type of sound, etc.

Processing circuitry 200 of each microphone-equipped playback device 110*a* 110*b* 110*c* 110*d* can receive (e.g. at microphone subsystem 230) the inbound calibration sound 520, detect (e.g. at delay calibration module 250) that listener-position-generated calibration sound has been received (e.g. by detecting data indicative of the listener-position-generated calibration sound), and note (e.g. at delay calibration module 250) the time of arrival (e.g. in accordance with a time provided by clock subsystem 270).

The detection of the calibration sound can be performed—for example—by utilizing a speech-to-text module.

In some such embodiments, the processing circuitry 200 does not in all cases detect the listener-position-generated calibration sound or its arrival time. In some such embodiments, when the listener-position-generated calibration sound is identified on a first device using e.g. a speech to text module, the processing circuitry 200 of a first microphone-equipped playback device requests a recording of the recent seconds of received audio from each of the peer microphone-equipped playback devices. Then, using—for example—gcc-phat (general cross correlation phase transform algorithm which is an advanced cross-correlation algorithm), the processing circuitry 200 of the first device compares the calibration sound location in all each recording of the peer devices to the calibration sound location in the recording of the first, and the time differences between each peer device to the first device can be calculated.

It is noted that the delay between the origination of the calibration sound at the listener position and the detection of the sound at a processing circuitry (eg. delay calibration module 250) can include several components such as: the distance-dependent sound propagation delay, and the ingress delay of the microphone-equipped playback device etc. It is further noted that the ingress delay can include the time necessary for analog-to-digital conversion and other delays.

In some embodiments, processing circuitry (eg. delay calibration module 250) can also detect the loudness of the calibration sound.

It is noted that the teachings of the presently disclosed subject matter are not bound by the flow diagram illustrated in FIG. 5A. It is also noted that whilst the flow chart is described with reference to elements of the systems of FIG. 2 and FIG. 5B, this is by no means binding, and the operations can be performed by elements other than those described herein.

Figure 6A:
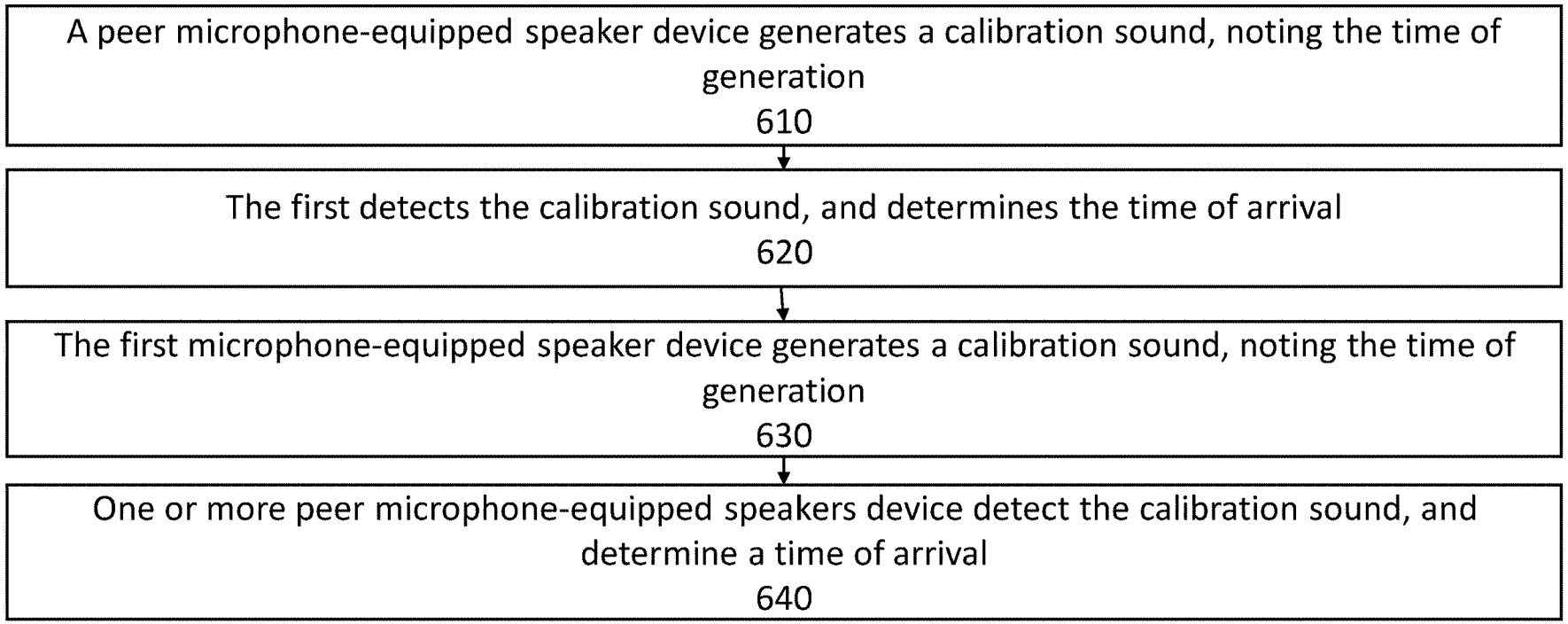
FIG. 6A illustrates a flow diagram of an example of a calibration method termed an inter-peer latency detection procedure, in accordance with some embodiments of the presently described subject matter.
Figure 6B:
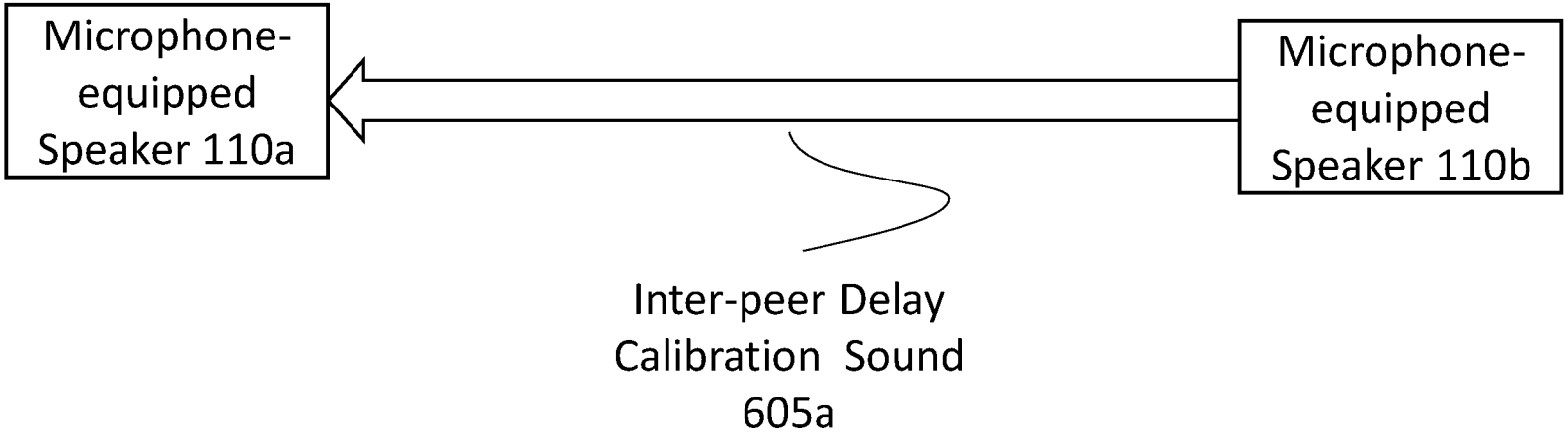
FIG. 6B illustrates an example deployment scenario and audio flow, in accordance with some embodiments of the presently described subject matter.
Figure 6C:
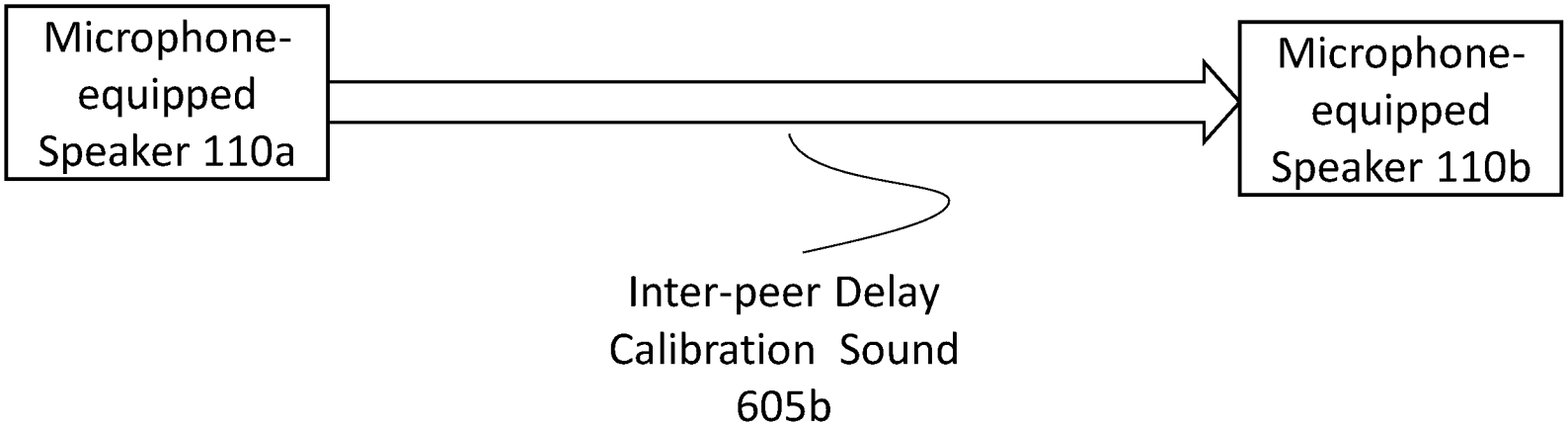
FIG. 6C illustrates an example deployment scenario and audio flow, in accordance with some embodiments of the presently described subject matter.

Attention is now directed to FIG. 6A, which illustrates a flow diagram of an example of a calibration method termed an inter-peer latency detection procedure, in accordance with some embodiments of the presently disclosed subject matter. FIGS. 6B-6C illustrate a corresponding example deployment scenario and audio flow, in accordance with some embodiments of the presently disclosed subject matter.

Processing circuitry 200 (e.g. delay calibration module 250) of peer microphone-equipped playback device 110*b* can generate (610) a calibration sound 605*a*. This can be e.g music that is played at the time, "pink noise" etc.

Processing circuitry 200 of microphone-equipped playback device 110*a* can receive (620) (e.g. at microphone subsystem 230) peer-generated calibration sound 605*a*, detect (e.g. at delay calibration module 250) that peer-generated calibration sound 605*a* has been received (e.g. by receiving data indicative of the calibration signal), and note (e.g. at delay calibration module 250) the time of arrival (e.g. in accordance with a time provided by clock subsystem 270).

It is noted that the delay between the generation of the calibration sound at the generating microphone-equipped playback device 110*b* and the noting of the time of sound arrival at the processing circuitry 200 (e.g. at delay calibration module 250) of receiving microphone-equipped playback device 110*a* can include several components including: egress delay from the peer microphone-equipped speaker device, the distance-dependent sound propagation delay, and the ingress delay of the microphone-equipped speaker device. It is further noted that the egress delay can include the time necessary for digital-to-analog conversion and other delays, and that ingress delay can include the time necessary for analog-to-digital conversion and other delays.

It is further noted that—in some embodiments—the time of generation of the calibration sound at microphone-equipped playback device 110*b* is the time of generation at its processing circuitry 200 (e.g. at delay calibration module 250).

Similarly, microphone-equipped playback device 110*a* can generate (630) a calibration sound 605*b* and note the transmission time. Calibration sound 605*b* can then be received at peer microphone-equipped playback device 110*b*, which can detect the calibration sound and note the arrival time. It is noted that—in some embodiments—the time of arrival of the calibration sound at receiving microphone-equipped playback device 110*b* is its time of reception at its processing circuitry 200 (e.g. at delay calibration module 250).

Additional peer microphone-equipped playback devices can also receive calibration sound 605*b*, detect that calibration sound 605*b* has been received, and note the time of arrival.

It is noted that various mechanisms (e.g. network-based messaging) can be used to ensure that the microphone-equipped playback devices do not simultaneously generate calibration sounds.

It is noted that the teachings of the presently disclosed subject matter are not bound by the flow diagram illustrated in FIG. 6A, and that in some cases the illustrated operations may occur concurrently or out of the illustrated order (eg. steps 610 and 630). It is also noted that whilst the flow chart is described with reference to elements of the systems of FIG. 2 and FIG. 6B-6C, this is by no means binding, and the operations can be performed by elements other than those described herein.

Figure 7:
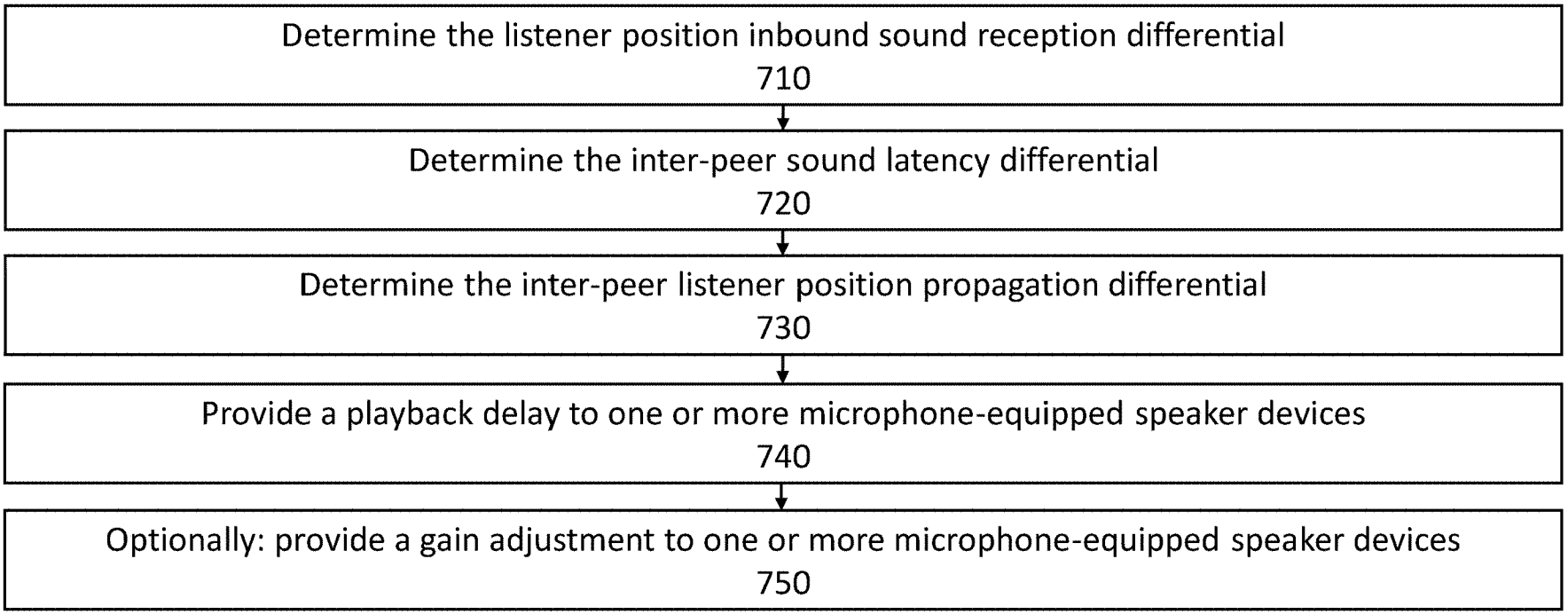
FIG. 7 illustrates a flow diagram of an example method for calculating per-device-pair listener position propagation differentials from calibration data collected by microphone-equipped playback devices, in accordance with some embodiments of the presently described subject matter.

Attention is now directed to FIG. 7, which illustrates a flow diagram of an example method for calculating per-device-pair listener position propagation differentials from calibration data collected by microphone-equipped playback devices, in accordance with some embodiments of the presently disclosed subject matter.

In some embodiments, the method is performed by a central server which receives calibration measurements (timing and loudness) from each microphone-equipped speaker device. In some such embodiments, this server can be colocated in one of the microphone-equipped playback devices (e.g delay calibration module 250). In some embodiments, the method can be implemented in a distributed manner utilizing multiple servers and microphone-equipped playback devices.

For clarity, the following description addresses a case of synchronizing two microphone-equipped playback devices. In scenarios involving more than two microphone-equipped playback devices, the method can be performed repeatedly—for example between a first microphone-equipped playback device and each peer microphone-equipped playback device.

Processing circuitry 200 (e.g delay calibration module 250) can determine (710)—for a pair of microphone-equipped playback devices—a value herein termed a listener position inbound sound reception differential, for example as described below with reference to FIG. 10.

Processing circuitry 200 (e.g delay calibration module 250) can determine (720)—for the pair of microphone-equipped playback devices—a value herein termed a inter-peer sound latency differential, for example as described below with reference to FIG. 9.

Processing circuitry 200 (e.g delay calibration module 250) can determine (720)—for a pair of microphone-equipped playback devices—a value herein termed listener position propagation differential, for example by subtracting the listener position inbound sound reception differential from the inter-peer sound latency differential.

It is noted that in some embodiments, the inter-peer sound latency differential is in accordance with the expression:

$$D1-\text{EgressLatency1}+\text{PeerSoundPropagationLatency}+\text{IngressLatency2}-\text{EgressLatency2}-\text{PeerSoundPropagationLatency}-\text{IngressLatency1}$$

where PeerSoundPropagationLatency refers to the sound propagation delay from one peer to the other (and in which the propagation latencies are assumed to be the same), and where EgressLatency1 refers to the egress latency for the first device etc.

Similarly it is noted that in some embodiments, the listener position inbound sound reception differential is in accordance with the expression:

$$D2=\text{IngressLatency1}+\text{LPSoundPropagationLatency1}-\text{IngressLatency2}-\text{LPSoundPropagationLatency2}$$

Consequently, in some embodiments, D1−D2 is in accordance with the expression:

$$(\text{EgressLatency1}-\text{EgressLatency1})+(\text{LPSoundPropagationLatency1}-\text{LPSoundPropagationLatency2})$$

and is thus indicative of the difference in egress delay and propagation delay to the listener position 200.

It is noted that this calculation also compensates for any deviation between the clocks of the two microphone-equipped playback devices—so that the clocks need not be synchronized.

Processing circuitry 200 (e.g delay calibration module 250) can then provide (740) an audio playback delay value to one or more microphone-equipped playback devices in accordance with the listener position propagation differential, to enable synchronized sound arrival at the listener position 100, as described above with reference to FIGS. 3-4.

Optionally: processing circuitry 200 (e.g delay calibration module 250) can then provide (740) a gain adjustment to one or more microphone-equipped playback devices. The gain adjustment can be derivative of:

a) a loudness of the first calibration sound detected by the processor, and b) a loudness of the first calibration sound detected by the second microphone-equipped playback device.

In some embodiments, the gain adjustment is in accordance with (for example: equal to) a ratio between the loudness of the first calibration sound detected by the processor, and the loudness of the first calibration sound detected by the second microphone-equipped playback device.

It is noted that the teachings of the presently disclosed subject matter are not bound by the flow diagram illustrated in FIG. 7, and that in some cases the illustrated operations may occur concurrently or out of the illustrated order (eg. steps 720 and 710). It is also noted that whilst the flow chart is described with reference to elements of the systems of FIG. 2, this is by no means binding, and the operations can be performed by elements other than those described herein.

Figure 8:
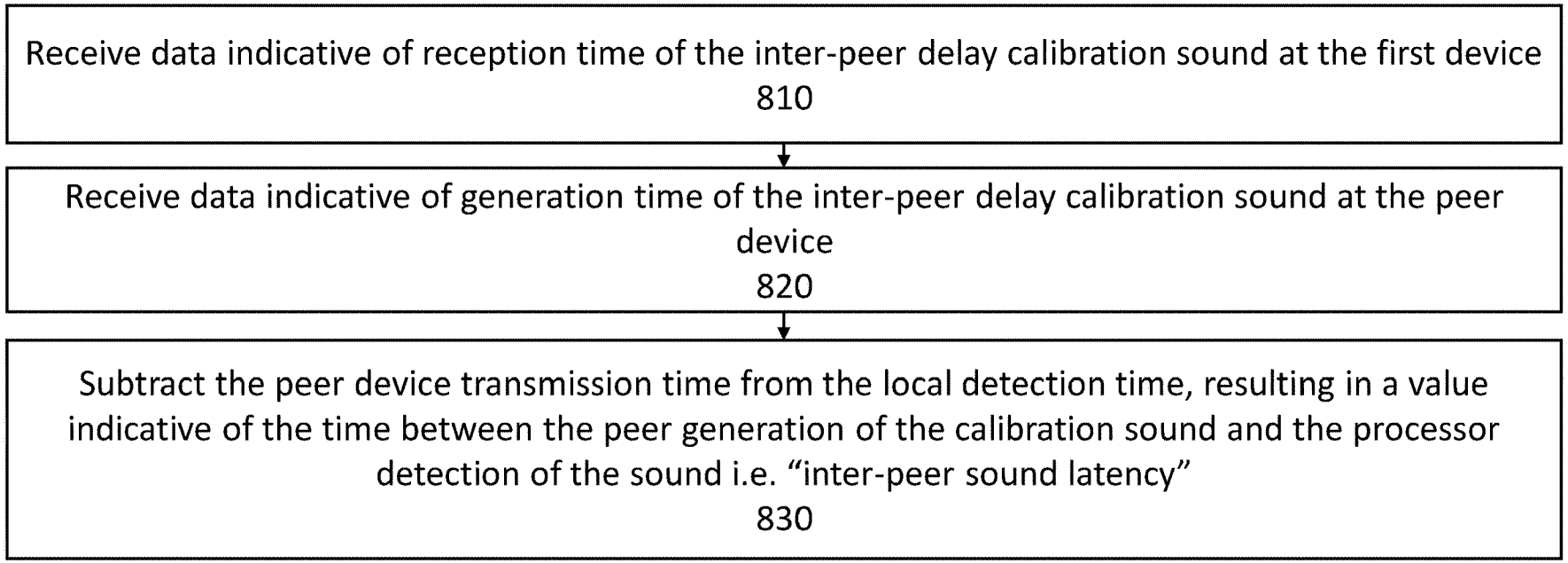
FIG. 8 illustrates a flow diagram of an example method of calculating an inter-peer sound latency for two microphone-equipped playback devices, in accordance with some embodiments of the presently described subject matter.

Attention is now directed to FIG. 8, which illustrates a flow diagram of an example method of calculating an inter-peer sound latency for two microphone-equipped playback devices, in accordance with some embodiments of the presently disclosed subject matter.

In some embodiments, the method is performed by a central server which receives calibration measurements from each microphone-equipped speaker device. In some such embodiments, this server can be colocated in one of the microphone-equipped playback devices (e.g delay calibration module 250). In some embodiments, the method can be implemented in a distributed manner utilizing multiple servers and microphone-equipped playback devices.

For clarity, the following description addresses a case of synchronizing two microphone-equipped playback devices.

Processing circuitry 200 (e.g delay calibration module 250) can receive (810) data indicative of reception time of the inter-peer delay calibration sound at a first device.

Processing circuitry 200 (e.g delay calibration module 250) can receive (820) data indicative of generation time of the inter-peer delay calibration sound at a peer device.

Processing circuitry 200 (e.g delay calibration module 250) can subtract (830) the peer device transmission time from the first device reception time, resulting in a value indicative of the time between the peer generation of the calibration sound and the processor detection of the sound i.e. "inter-peer sound latency"

It is noted that the teachings of the presently disclosed subject matter are not bound by the flow diagram illustrated in FIG. 8, and that in some cases the illustrated operations may occur concurrently or out of the illustrated order (eg. steps 810 and 820). It is also noted that whilst the flow chart is described with reference to elements of the systems of FIG. 2, this is by no means binding, and the operations can be performed by elements other than those described herein.

Figure 9:
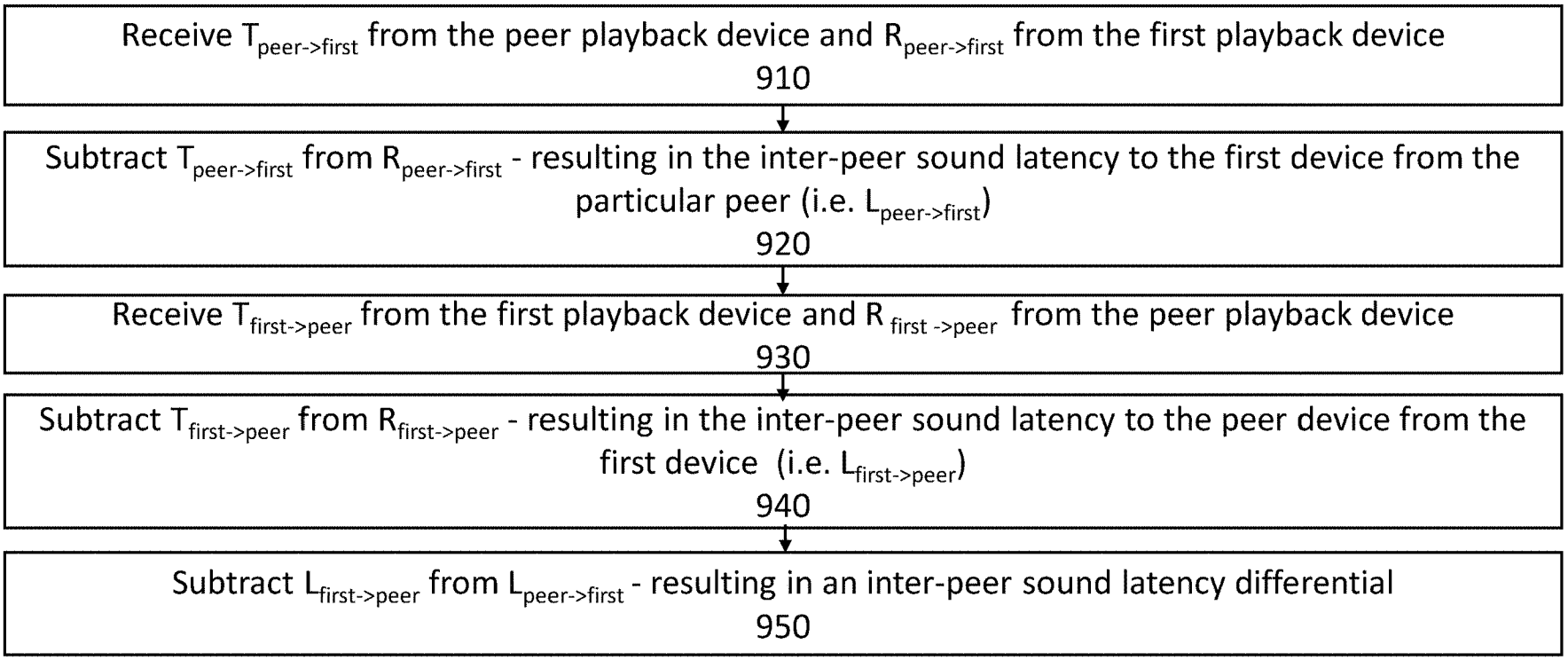
FIG. 9 illustrates a flow diagram of an example method of computing an inter-peer sound latency differential from calibration data, in accordance with some embodiments of the presently described subject matter.

Attention is now directed to FIG. 9, which illustrates a flow diagram of an example method of computing an inter-peer sound latency differential from calibration data, in accordance with some embodiments of the presently disclosed subject matter.

In some embodiments, the method is performed by a central server which receives calibration measurements from each microphone-equipped speaker device. In some such embodiments, this server can be colocated in one of the microphone-equipped playback devices(e.g delay calibration module 250). In some embodiments, the method can be implemented in a distributed manner utilizing multiple servers and microphone-equipped playback devices.

For clarity, the following description addresses a case of synchronizing two microphone-equipped playback devices.

Processing circuitry 200 (e.g. delay calibration module 250) can receive (910) $T_{peer\rightarrow first}$ from the peer microphone-equipped playback device and $R_{peer\rightarrow first}$ from the first microphone-equipped playback device.

Processing circuitry 200 (e.g. delay calibration module 250) can subtract (920) $T_{peer\rightarrow first}$ from $R_{peer\rightarrow first}$ resulting in the inter-peer sound latency to the first microphone-equipped playback device from the particular peer (i.e. $L_{peer\rightarrow first}$).

Processing circuitry 200 (e.g. delay calibration module 250) can receive (930) $T_{first\rightarrow peer}$ from the first microphone-equipped playback device and $R_{first\rightarrow peer}$ from the peer playback device.

Processing circuitry 200 (e.g. delay calibration module 250) can subtract (940) $T_{first\rightarrow peer}$ from $R_{first\rightarrow peer}$ —resulting in the inter-peer sound latency to the peer microphone-equipped playback device from the first device (i.e. $L_{first\rightarrow peer}$).

Processing circuitry 200 (e.g. delay calibration module 250) can subtract (950) $L_{first\rightarrow peer}$ from $L_{peer\rightarrow first}$ resulting in an inter-peer sound latency differential.

It is noted that the teachings of the presently disclosed subject matter are not bound by the flow diagram illustrated in FIG. 9, and that in some cases the illustrated operations may occur concurrently or out of the illustrated order (eg. steps 910 and 930). It is also noted that whilst the flow chart is described with reference to elements of the systems of FIG. 2, this is by no means binding, and the operations can be performed by elements other than those described herein.

Figure 10:
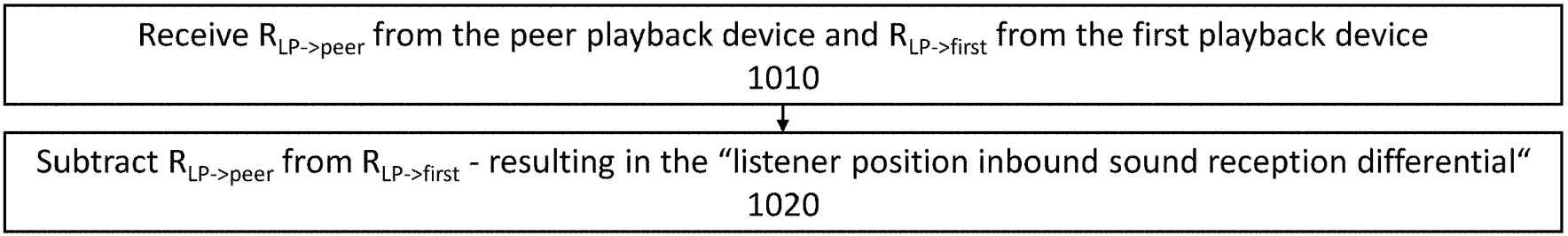
FIG. 10 illustrates a flow diagram of an example method of computing a listener position inbound sound reception differential from calibration data, in accordance with some embodiments of the presently described subject matter.

Attention is now directed to FIG. 10, which illustrates a flow diagram of an example method of computing a listener position inbound sound reception differential from calibration data, in accordance with some embodiments of the presently disclosed subject matter.

In some embodiments, the method is performed by a central server which receives calibration measurements from each microphone-equipped speaker device. In some such embodiments, this server can be colocated in one of the microphone-equipped playback devices (e.g delay calibration module 250). In some embodiments, the method can be implemented in a distributed manner utilizing multiple servers and microphone-equipped playback devices.

For clarity, the following description addresses a case of synchronizing two microphone-equipped playback devices.

Processing circuitry 200 (e.g. delay calibration module 250) can receive (1010) $R_{LP\rightarrow peer}$ from the peer microphone-equipped playback device and $R_{LP\rightarrow first}$ from the first microphone-equipped playback devices.

Processing circuitry 200 (e.g. delay calibration module 250) can subtract (1020) $R_{LP\rightarrow peer}$ from $R_{LP\rightarrow first}$ —resulting in the listener position inbound sound reception differential.

It is noted that the teachings of the presently disclosed subject matter are not bound by the flow diagram illustrated in FIG. 10. It is also noted that whilst the flow chart is described with reference to elements of the systems of FIG. 2, this is by no means binding, and the operations can be performed by elements other than those described herein.

It is to be understood that the invention is not limited in its application to the details set forth in the description contained herein or illustrated in the drawings. The invention is capable of other embodiments and of being practiced and carried out in various ways. Hence, it is to be understood that the phraseology and terminology employed herein are for the purpose of description and should not be regarded as limiting. As such, those skilled in the art will appreciate that the conception upon which this disclosure is based may readily be utilized as a basis for designing other structures, methods, and systems for carrying out the several purposes of the presently disclosed subject matter.

It will also be understood that the system according to the invention may be, at least partly, implemented on a suitably programmed computer. Likewise, the invention contemplates a computer program being readable by a computer for executing the method of the invention. The invention further contemplates a non-transitory computer-readable memory tangibly embodying a program of instructions executable by the computer for executing the method of the invention.

Those skilled in the art will readily appreciate that various modifications and changes can be applied to the embodiments of the invention as hereinbefore described without departing from its scope, defined in and by the appended claims.

The invention claimed is:

1. A method of synchronizing playback of digital audio to a listener position, the method comprising:

a) receiving, by a first processor of a first microphone-equipped playback device, data indicative of digital audio; and b) playing the digital audio, by the first processor, on a speaker of the first microphone-equipped playback device, in accordance with a playback delay, the playback delay being derivative of, at least, first data, and a difference between second data and third data, wherein:

the first data are in accordance with a difference between an arrival time of a first calibration sound at the first processor and an arrival time of the first calibration sound at a second microphone-equipped playback device, wherein the first calibration sound originated at the listener position, the second data are in accordance with a difference between a generation time of a second calibration sound at the second microphone-equipped playback device and an arrival time of the second calibration sound at the first processor, and the third data is in accordance with a difference between a generation time of a third calibration sound at the first processor and an arrival time of the third calibration sound at the second microphone-equipped playback device;

thereby synchronizing arrival of sound of the first microphone-equipped playback device and the second microphone-equipped playback device at the listener position.

2. The method of claim 1, wherein the playback delay is in accordance with, at least, a difference between:

i) an inter-peer calibration sound latency differential; and ii) a listener position inbound sound reception differential;

wherein the inter-peer calibration sound latency differential is in accordance with a difference between:

i) a difference between the generation time of the second calibration sound and the arrival time of the second calibration sound, and ii) a difference between the generation time of the third calibration sound and the arrival time of the third calibration sound; and wherein the listener position inbound sound reception differential is in accordance with a difference between the arrival time of the first calibration sound at the first processor and the arrival time of the first calibration sound at the second microphone-equipped playback device.

3. The method of claim 1, wherein the playback delay is in further accordance with one or more additional listener position propagation differentials, wherein each listener position propagation differential is derivative of, at least:

i) data indicative of an arrival time of the first calibration sound at a respective additional microphone-equipped playback device, ii) data indicative of a generation time of a respective additional calibration sound at the respective additional microphone-equipped playback device, and data indicative of an arrival time of the respective additional calibration sound at the first processor, and iii) data indicative of an arrival time of a calibration sound, generated by the first processor, at the respective additional microphone-equipped playback device, and data indicative of a generation time of the calibration sound by the first processor;

thereby compensating for differences in delay among the first, second, and one or more additional microphone-equipped playback devices, to the listener position.

4. The method of claim 1, wherein the playing the digital audio is in accordance with a gain adjustment, the gain adjustment being derivative of:

a) a loudness of the first calibration sound detected by the first processor, and b) a loudness of the first calibration sound detected by the second microphone-equipped playback device.

5. The method of claim 4, wherein the gain adjustment is in accordance with a ratio between the loudness of the first calibration sound detected by the first processor, and the loudness of the first calibration sound detected by the second microphone-equipped playback device.

6. The method of claim 1, wherein the arrival times of the first calibration sound and the second calibration sound, and the generation time of the third calibration sound are in accordance with a local clock of the first microphone-equipped playback device, and wherein the arrival times of the first calibration sound and the third calibration sound and the generation time of the second calibration sound are in accordance with a local clock of the second microphone-equipped playback device.

7. The method of claim 6, wherein the local clock of the first microphone-equipped playback device and the local clock of the second microphone-equipped playback device are synchronized.

8. The method of claim 1, wherein at least one sound of a set consisting of the second calibration sound and the third calibration sound comprises pink noise.

9. The method of claim 1, wherein at least one sound of a set consisting of the second calibration sound and the third calibration sound is comprised in music playback.

10. The method of claim 1, wherein the arrival time of the first calibration sound at the second microphone-equipped playback device is an arrival time of data indicative of the first calibration sound at a second processor of the second microphone-equipped playback device, the generation time of the second calibration sound at the second microphone-equipped playback device is a generation time of the second calibration sound at the second processor of the second microphone-equipped playback device, and the arrival time of the third calibration sound at the second microphone-equipped playback device is an arrival time of data indicative of the third calibration sound at the second processor of the second microphone-equipped playback device.

11. The method of claim 1, wherein a derivation of the playback delay includes a subtraction between $\Delta t2$ and $\Delta t3$, wherein:

$\Delta t2$ includes a generation time of a second calibration sound at a second processor of the second microphone-equipped playback device, relative to an arrival time of the second calibration sound at the first processor, and $\Delta t3$ includes a generation time of a third calibration sound at the first processor relative to an arrival time of the third calibration sound at the second processor.

12. The method of claim 11, wherein the derivation includes a subtraction $\Delta t2-\Delta t3-\Delta t1$, wherein:

$\Delta t1$ includes a difference between an arrival time of a first calibration sound at the first processor relative to an arrival time of the first calibration sound at the second processor of the second microphone-equipped playback device.

13. A computerized microphone-equipped audio playback device comprising a processing circuitry, the processing circuitry comprising a first processor, a memory, a speaker and a microphone, the processing circuitry being configured to:

a) receive data indicative of digital audio; and play the digital audio on the speaker, in accordance with a playback b) that is derivative of, at least, first data, and a difference between second data and third data, wherein:

the first data are in accordance with a difference between an arrival time of a first calibration sound at the first processor and an arrival time of the first calibration sound at a second microphone-equipped audio playback device, wherein the first calibration sound originated at the listener position, the second data are in accordance with a difference between a generation time of a second calibration sound at the second microphone-equipped audio playback device, and an arrival time of the second calibration sound at the first processor, and the third data are in accordance with a difference between a generation time of a third calibration sound at the first processor, and an arrival time of the third calibration sound at the second microphone-equipped audio playback device;

thereby synchronizing arrival of sound of the first microphone-equipped audio playback device and the second microphone-equipped audio playback device at the listener position.

14. A computer program product comprising a non-transitory computer readable storage medium retaining program instructions, which, when read by a processing circuitry, cause the processing circuitry to perform a computerized method of synchronizing playback of digital audio to a listener position, the method comprising:

a) receiving data indicative of digital audio; and playing the digital audio in accordance with a playback delay, b) the playback delay being derivative of, at least, first data, and a difference between second data and third data, wherein:

the first data is in accordance with a difference between an arrival time of a first calibration sound at a first processor and of an arrival time of the first calibration sound at a second microphone-equipped playback device, wherein the first calibration sound originated at the listener position, the second data is in accordance with a difference between a generation time of a second calibration sound at the second microphone-equipped playback device, and an arrival time of the second calibration sound at the first processor, and the third data is in accordance with a difference between a generation time of a third calibration sound at the first processor, and an arrival time of the third calibration sound at the second microphone-equipped playback device;

thereby synchronizing arrival of sound of the first microphone-equipped playback device and the second microphone-equipped playback device at the listener position.

* * * * *